US011370081B2

(12) United States Patent
Chen et al.

(10) Patent No.: US 11,370,081 B2
(45) Date of Patent: Jun. 28, 2022

(54) SYNCHRONOUS GRINDING-DEBURRING METHOD AND SYSTEM FOR VALVE SPOOL BASED ON MEASUREMENT OF OVERLAP VALUE

(71) Applicant: Shanghai Jiao Tong University, Shanghai (CN)

(72) Inventors: Ming Chen, Shanghai (CN); Qinglong An, Shanghai (CN); Weiwei Ming, Shanghai (CN); Jianwen Wang, Shanghai (CN); Jiaqiang Dang, Shanghai (CN); Chang Liu, Shanghai (CN)

(73) Assignee: Shanghai Jiao Tong University, Shanghai (CN)

( * ) Notice: Subject to any disclaimer, the term of this patent is extended or adjusted under 35 U.S.C. 154(b) by 0 days.

(21) Appl. No.: 17/475,298

(22) Filed: Sep. 14, 2021

(65) Prior Publication Data

US 2022/0001509 A1 Jan. 6, 2022

Related U.S. Application Data

(63) Continuation of application No. PCT/CN2020/111590, filed on Aug. 27, 2020.

(30) Foreign Application Priority Data

Aug. 28, 2019 (CN) ..... 20191080179.4

(51) Int. Cl.

| | |
|---|---|
| ***B24B 51/00*** | (2006.01) |
| ***B24B 9/00*** | (2006.01) |
| ***B24B 49/12*** | (2006.01) |

(52) U.S. Cl.

CPC ..... *B24B 51/00* (2013.01); *B24B 9/00* (2013.01); *B24B 49/12* (2013.01)

(58) Field of Classification Search

CPC .. B24B 51/00; B24B 9/00; B24B 9/04; B24B 9/005; B24B 49/12; B24B 5/04;

(Continued)

(56) References Cited

U.S. PATENT DOCUMENTS

2011/0009031 A1* 1/2011 Honegger ..... B24B 5/02 451/6
2019/0152015 A1* 5/2019 Naderer ..... B24D 9/085

FOREIGN PATENT DOCUMENTS

CN 101402180 A 4/2009
CN 104070183 A 10/2014

(Continued)

OTHER PUBLICATIONS

Wang Zhuo, Huang Chuan, Shen Zhenfeng, Liu Xiaotian, Jiang Jinlin and Zhu Limin; Pneumatic Measuring System for Overlap Value of Low-flow Electro-hydraulic Servo Valve; May 15, 2017; Shanghai Institute of Spaceflight Control Technology, Shanghai 201109.

(Continued)

*Primary Examiner* — Joel D Crandall

(57) ABSTRACT

A synchronous grinding-deburring method and system for a valve spool based on measurement of an overlap value. In the system, a synchronous grinding-deburring machine is configured to complete automatic clamping of the valve spool workpiece and synchronous precise grinding-deburring processing of a working edge; a loading-unloading robot is configured to grab and transport the valve spool workpiece; and a charged-coupled device (CCD)-based industrial visual camera is provided to facilitate an automatic assembly of a slide valve pair; a computer-based pneumatic mate-grinding test bench for an electro-hydraulic servo valve is provided for automatic clamping of the servo valve and automatic detection of the overlap value of a servo valve;

(Continued)

and an industrial control console is provided for real-time control of a complete workflow and adaptive control of a processing parameter.

1 Claim, 2 Drawing Sheets

(58) Field of Classification Search
CPC .... B24B 5/22; B24B 5/30; B24B 5/42; B24B 15/02; B24B 15/04
See application file for complete search history.

(56) References Cited

FOREIGN PATENT DOCUMENTS

| | | | |
|---|---|---|---|
| CN | 105841647 | A | 8/2016 |
| CN | 106002294 | A | 10/2016 |
| CN | 106272416 | A | 1/2017 |
| CN | 107717665 | A | 2/2018 |
| CN | 207104177 | U | 3/2018 |
| CN | 107962458 | A | 4/2018 |
| CN | 108591183 | A | 9/2018 |
| CN | 109333361 | A | 2/2019 |
| CN | 209125610 | U | 7/2019 |
| CN | 110549188 | A | 12/2019 |
| JP | S5482790 | A | 7/1979 |
| JP | 5051826 | B2 | 10/2012 |

OTHER PUBLICATIONS

Zhang Xinbin, Wang Bin and Zhang Shuangtian; Overlap Value of Valve's Slide Valve Couples with Pneumatic Testing Method; Nov. 15, 2015; Shanghai Institute of Spaceflight Control Technology, Shanghai 201109.

* cited by examiner

SYNCHRONOUS GRINDING-DEBURRING METHOD AND SYSTEM FOR VALVE SPOOL BASED ON MEASUREMENT OF OVERLAP VALUE

CROSS-REFERENCE TO RELATED APPLICATIONS

This application is a continuation of International Application No. PCT/CN2020/111590, filed on Aug. 27, 2020, which claims the benefit of priority from Chinese Patent Application No. 201910801794.4, filed on Aug. 28, 2019. The content of the aforementioned applications, including any intervening amendments thereto, are incorporated herein by reference.

TECHNICAL FIELD

This application relates to mechanical processing and manufacturing, and more particularly to a synchronous grinding-deburring method and system for a valve spool based on measurement of an overlap value.

BACKGROUND

An electro-hydraulic servo valve has been widely used in hydraulic servo systems. During the manufacturing process of the servo, the valve spool is generally ground by a high-precision cylindrical grinder first, and finally a working edge of the valve spool is subjected to cross grinding and manual deburring. Such traditional process has poor processing efficiency and high rejection rate, and moreover, the integrity of the working edge is prone to being damaged during the deburring process. Currently, several automated systems, such as a computer numerical control (CNC) deburring system and a robot-based deburring workstation, have been designed and manufactured to complete the grinding and deburring process, which enhances the deburring efficiency and reduces the labor intensity to a certain extent. However, with respect to the servo valve spool, the existing deburring processes fail to take the measurement and feedback of performance indicators of the workpiece into consideration, and thus are not suitable for the industrial production of high-precision servo valves.

SUMMARY

An object of this application is to provide a synchronous grinding-deburring method and system for a valve spool based on measurement of an overlap value to overcome the defects in prior art, in which a synchronous grinding-deburring machine for a servo valve spool, an loading and unloading industrial robot and a computer-based pneumatic mate-grinding test platform for an electro-hydraulic servo valve are provided to realize the automation and integration of synchronous grinding-deburring processing of the servo valve spool and measurement of the overlap value, allowing for low labor intensity, desirable processing efficiency, excellent manufacturing precision and high yield. In addition, each working unit has a clear functional division, flexible assembly and debugging and a high degree of flexibility. As a consequence, the synchronous grinding-deburring method and system are suitable for the industrial production of servo valves.

Technical solutions of this disclosure are described as follows.

In a first aspect, this application provides a synchronous grinding-deburring method for a valve spool workpiece based on measurement of an overlap value, comprising:

automatically loading, by a synchronous grinding-deburring machine, the valve spool workpiece;

synchronously grinding and deburring, by the synchronous grinding-deburring machine, a working edge of the valve spool workpiece;

grasping and transporting, by a loading-unloading robot, the valve spool workpiece;

performing automatic assembly of a slide valve pair with the help of a charged-coupled device (CCD)-based industrial visual camera;

automatically loading, by a computer-based pneumatic mate-grinding test platform for an electro-hydraulic servo valve, the slide valve pair;

automatically measuring, by the computer-based pneumatic mate-grinding test platform, the overlap value of a servo valve; and performing, by an industrial control console, real-time control of a complete workflow and adaptive control of processing parameters;

wherein the synchronous grinding-deburring machine is provided with an automatic valve spool clamping mechanism, a workpiece clamping detection system, a grinding system and an automatic deburring system; and the synchronous grinding-deburring machine is configured to realize synchronous grinding and deburring of the valve spool workpiece, to cooperate with the loading-unloading robot to automatically clamp the valve spool workpiece, to detect whether a clamping process is completed, and to output a clamping completion signal when the clamping process is detected to be completed;

the automatic loading of the valve spool workpiece is performed through steps of: grabbing and transporting, by the loading-unloading robot, the valve spool workpiece to a clamping jaw of the synchronous grinding-deburring machine; opening the clamping jaw and clamping the valve spool workpiece by the automatic valve spool clamping mechanism; automatically closing the clamping jaw by the automatic valve spool clamping mechanism to stably clamp the valve spool workpiece; and outputting the clamping completion signal to the industrial control console after the workpiece clamping detection system detects that the valve spool workpiece is clamped;

the synchronous grinding and deburring of the working edge of the valve spool workpiece is performed through steps of: driving, by the synchronous grinding-deburring machine, the valve spool workpiece to rotate; axially grinding, by the grinding system, the valve spool workpiece; and at the same time, radially feeding and deburring, by the automatic deburring system, the valve spool workpiece;

the automatic assembly of the slide valve pair is performed through steps of: grasping and transporting, by the loading-unloading robot, the valve spool workpiece to be close to a valve sleeve clamped by an automatic servo valve clamping mechanism provided on the computer-based pneumatic mate-grinding test platform; at the same time, detecting, by the CCD-based industrial visual camera above the automatic servo valve clamping mechanism, a position and posture of the valve spool workpiece at an end of the loading-unloading robot in real time; transmitting, by the CCD-based industrial visual camera, position and posture data of the valve spool workpiece to the industrial control console; and according to pre-calibrated position and posture data, controlling, by a system software, the loading-unloading robot to adjust an end position and posture to meet assembly requirements; and controlling, by the end of the loading-unloading robot, the value spool workpiece to move axially to complete the assembly of the slide valve pair;

the computer-based pneumatic mate-grinding test platform is provided with an overlap value measuring system, the automatic servo valve clamping mechanism and an overlap data processing computer; and the computer-based pneumatic mate-grinding test platform is configured to cooperate with the loading-unloading robot to realize automatic assembly of the valve spool and the valve sleeve and automatic clamping of a servo valve, to measure and preliminarily process the overlap value of the servo valve, and to output the measured overlap value;

the automatic clamping of the slide valve pair is performed through steps of: when the CCD-based industrial visual camera detects that the position and posture of the valve spool workpiece are matched with those of the valve sleeve, controlling, by the industrial control console, the automatic servo valve clamping mechanism to clamp the servo valve;

the automatic measurement of the overlap value of the servo valve is performed through steps of: automatically measuring, by the overlap value measuring system, the overlap value of the slide valve pair; at the same time, processing, by the overlap data processing computer, the measured overlap value in real time, and outputting, by the overlap data processing computer, processed overlap value data to the industrial control console;

the industrial control console comprises a central control module, a first control module, a second control module, a third control module and a monitor module; the first control module, the second control module, the third control module and the monitor module are respectively connected to the central control module; the first control module is connected to the synchronous grinding-deburring machine and is configured to monitor a working status of the synchronous grinding-deburring machine and transmit a working control signal of the synchronous grinding-deburring machine; the second control module is connected to the loading-unloading robot and is configured to monitor a working status of the loading-unloading robot and transmit a movement control signal of the loading-unloading robot; the third control module is connected to the computer-based pneumatic mate-grinding test platform and is configured to monitor a working status of the computer-based pneumatic mate-grinding test platform and transmit a working control signal of the computer-based pneumatic mate-grinding test platform; the monitor module is connected to the CCD-based industrial visual camera and is configured to monitor a position and posture signal of the valve spool workpiece during the assembly of the slide valve pair; and the central control module is provided with a user-oriented workflow operation panel and a control interface to process status data from other modules to obtain real-time workflow control instruction data; and the real-time control of the complete workflow and the adaptive control of the processing parameters are performed through steps of: determining, by the system software, whether the overlap value of the servo valve composed of the valve spool workpiece and the valve sleeve meets preset requirements; if not, according to the measured overlap value, performing calculation to determine a feed amount required for next grinding processing, and then transporting, by the loading-unloading robot, the valve spool workpiece to the synchronous grinding-deburring machine followed by synchronous grinding and deburring; and if yes, opening the automatic servo valve clamping mechanism and unloading the processed servo valve with the help of the loading-unloading robot to perform grinding and deburring on a next valve spool workpiece to be processed.

In a second aspect, this application provides a synchronous grinding-deburring system for a valve spool based on measurement of an overlap value, comprising:

an industrial control console;

a synchronous grinding-deburring machine for a servo valve spool;

a loading-unloading robot;

a computer-based pneumatic mate-grinding test platform for an electro-hydraulic servo valve; and a CCD-based industrial visual camera;

wherein the synchronous grinding-deburring machine, the loading-unloading robot, the computer-based pneumatic mate-grinding test platform and the CCD-based industrial visual camera are respectively connected to the industrial control console; the synchronous grinding-deburring machine is configured to output a real-time processing status signal of the valve spool workpiece and receive a first workflow control signal; the loading-unloading robot is configured to output a real-time position signal of an end of the loading-unloading robot during transportation of the valve spool workpiece and receive a second workflow control signal; the computer-based pneumatic mate-grinding test platform is configured to output detection data of the overlap value of the servo valve and receive a third workflow control signal; the CCD-based industrial visual camera is configured to output real-time position and posture data of the valve spool workpiece and receive a fourth workflow control signal; and the industrial control console is configured to receive and process working status signals and measurement data from the synchronous grinding-deburring machine, the loading-unloading robot, the computer-based pneumatic mate-grinding test platform and the CCD-based industrial visual camera, output the first workflow control signal, the second workflow control signal, the third workflow control signal and the fourth workflow control signal in accordance with a preset workflow, and adjust the processing parameters according to feedback signal data from a sensor system, such that real-time communication and control of each working unit and the adaptive control of the processing parameters are realized during process of synchronous grinding-deburring and measurement of the overlap value.

Compared to the prior art, this disclosure has the following beneficial effects.

Based on integrated application of a series of manufacturing devices needed for the batch production of electro-hydraulic servo valves, this application reasonably improves working modules according to requirements of a technological process, such that automation and integration of synchronous grinding-deburring processing for the servo valve spool and measurement of the overlap value are realized, allowing for improved processing efficiency and yield. At the same time, the valve spool manufacturing process provided herein has high automation degree, low labor intensity and production cost, and high safety and reliability. In addition, individual working units have a clear division of function, flexible assembly and debugging and high degree of flexibility. As a consequence, the synchronous grinding-deburring method and system of the disclosure are suitable for industrial large-scale production of the servo valves.

DETAILED DESCRIPTION OF EMBODIMENTS

In this embodiment, the synchronous grinding-deburring processing is performed on the servo valve spool workpiece which requires a high-precision working edge, and an overlap value of the servo valve is measured. Specifically, this application can realize the integration of the grinding-deburring of the working edge of the valve spool workpiece, automatic detection of the grinding-deburring effect and output of the overlap value.

Figure 1:
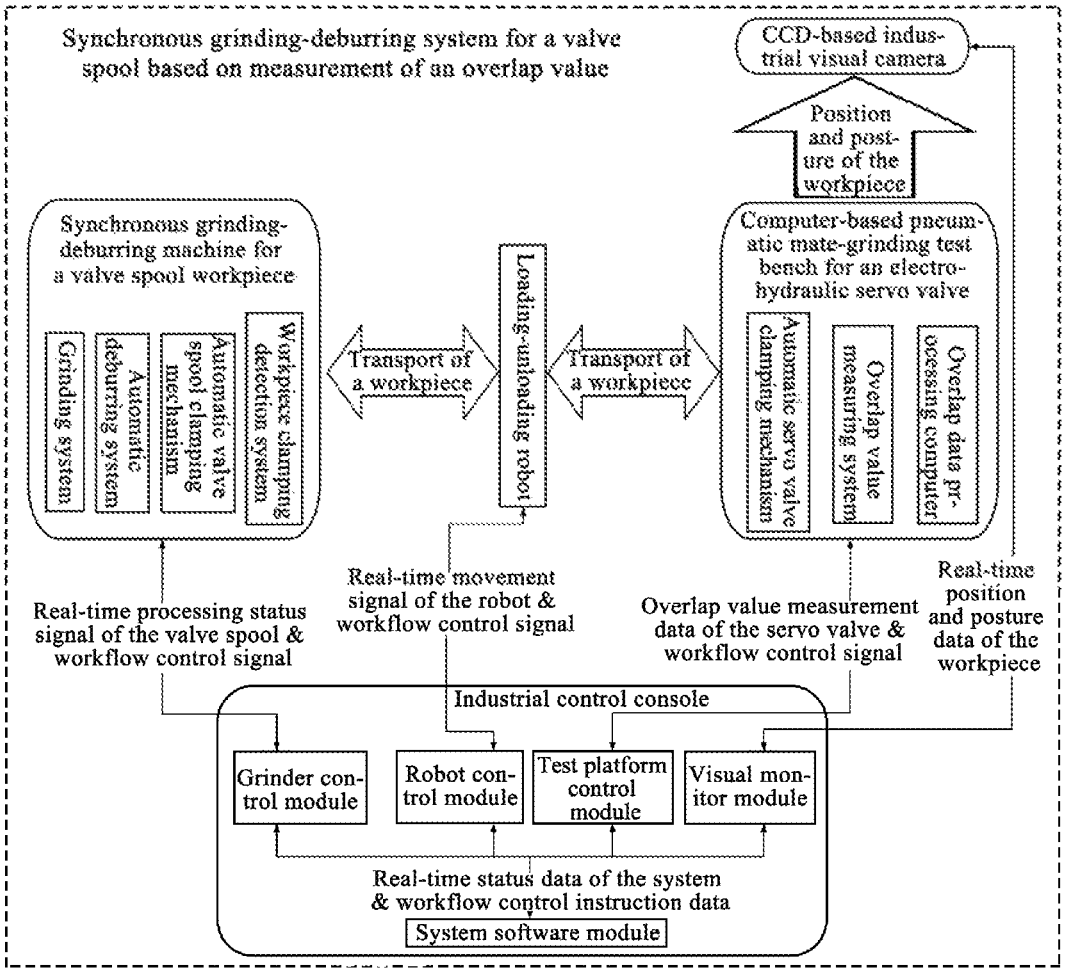
FIG. 1 is a schematic diagram of a synchronous grinding-deburring system for a valve spool workpiece according to an embodiment of the present disclosure.

Referring to an embodiment shown in FIG. 1, this application provides a synchronous grinding-deburring system for a valve spool workpiece based on measurement of an overlap value, including a synchronous grinding-deburring machine, a loading-unloading robot, a computer-based pneumatic mate-grinding test platform for an electro-hydraulic servo valve, a charged-coupled device (CCD)-based industrial visual camera and an industrial control console. The synchronous grinding-deburring machine, the loading-unloading robot, the computer-based pneumatic mate-grinding test platform and the CCD-based industrial visual camera are electrically connected to the industrial control console, respectively, realizing the real-time communication and control of each working unit and adaptive control of processing parameters during the process of synchronous grinding and deburring and measurement of the overlap value.

The synchronous grinding-deburring machine is provided with a grinding system, an automatic valve spool clamping mechanism, a workpiece clamping detection system. The synchronous grinding-deburring machine can realize the synchronous grinding and deburring of the valve spool workpiece, and can cooperate with the robot to automatically clamp the valve spool workpiece, detect whether a clamping process is completed and then output a clamping completion signal to the industrial control console. Moreover, the synchronous grinding-deburring machine can also receive a working control signal.

The grinding system includes a grinding head holder, a grinding tail holder, a grinding wheel and a grinding carriage, where the grinding head holder and the grinding tail holder are configured to support the valve spool workpiece; the grinding wheel is configured to drive grinding of the workpiece; the grinding carriage is configured for grinding feeding; and the grinding head holder and the grinding tail holder are respectively provided with a chuck and a centre for clamping and fixing the valve spool workpiece.

The automatic valve spool clamping mechanism includes a ball screw slide table, a servo motor and a motor drive controller. The ball screw slide table is connected to the grinding tail holder. The motor drive controller is configured to control the servo motor to output an angular displacement and a torque to drive the ball screw slide table to move along an axial direction of the workpiece and control an overall transmission of the grinding tail holder to realize cooperation of the grinding head holder and the grinding tail holder to clamp the workpiece. The motor drive controller is connected with the industrial control console to realize drag control of the servo motor.

The workpiece clamping detection system includes an embedded pressure sensor and an embedded controller. The embedded pressure sensor is provided inside a mechanical connection joint between the ball screw slide table and the grinding tail holder of the synchronous grinding-deburring machine. The embedded pressure sensor is configured to measure a pressure on the grinding tail holder when the workpiece is clamped and output a measured pressure analog quantity to the embedded controller. The embedded controller is configured to convert the analog quantity into a digital quantity for storage and preliminarily process and output the digital quantity to the industrial control console.

The loading-unloading robot is electrically connected to the industrial control console to output a movement signal and the position signal of the end of the loading-unloading robot and receive a working control signal at the same time.

The computer-based pneumatic mate-grinding test platform is provided with an overlap value measuring system, an automatic servo valve clamping mechanism and an overlap data processing computer. The automatic servo valve clamping mechanism is configured to clamp the servo valve. The computer-based pneumatic mate-grinding test platform cooperates with the loading-unloading robot to realize the automatic assembly of the valve spool and a valve sleeve and the automatic clamping of the servo valve, to detect and preliminarily process the overlap value of the servo valve, and to output the measured data.

The CCD-based industrial visual camera is electrically connected with the industrial control console to output position and posture data of the workpiece at an end of the robot to the industrial control console during the assembling of a slide valve pair.

The industrial control console includes a grinder control module, a robot control module, a test platform control module, a visual monitor module and a central control module. The grinder control module is connected to the synchronous grinding-deburring machine and is configured to monitor a working status of the synchronous grinding-deburring machine and transmit a working control signal of the synchronous grinding-deburring machine. The robot control module is connected to the loading-unloading robot and is configured to monitor a working status of the robot and transmit a movement control signal of the robot. The test platform control module is connected to the computer-based pneumatic mate-grinding test platform and is configured to monitor a working status of the computer-based pneumatic mate-grinding test platform and transmit a working control signal of the computer-based pneumatic mate-grinding test platform. The visual monitor module is connected to the CCD-based industrial visual camera and is configured to monitor a position and posture signal of the workpiece during the assembly of the slide valve pair. The central control module is configured to process status data from other modules to obtain real-time workflow control instruction data of the system and provide users with a workflow operation panel and a control interface.

Figure 2:
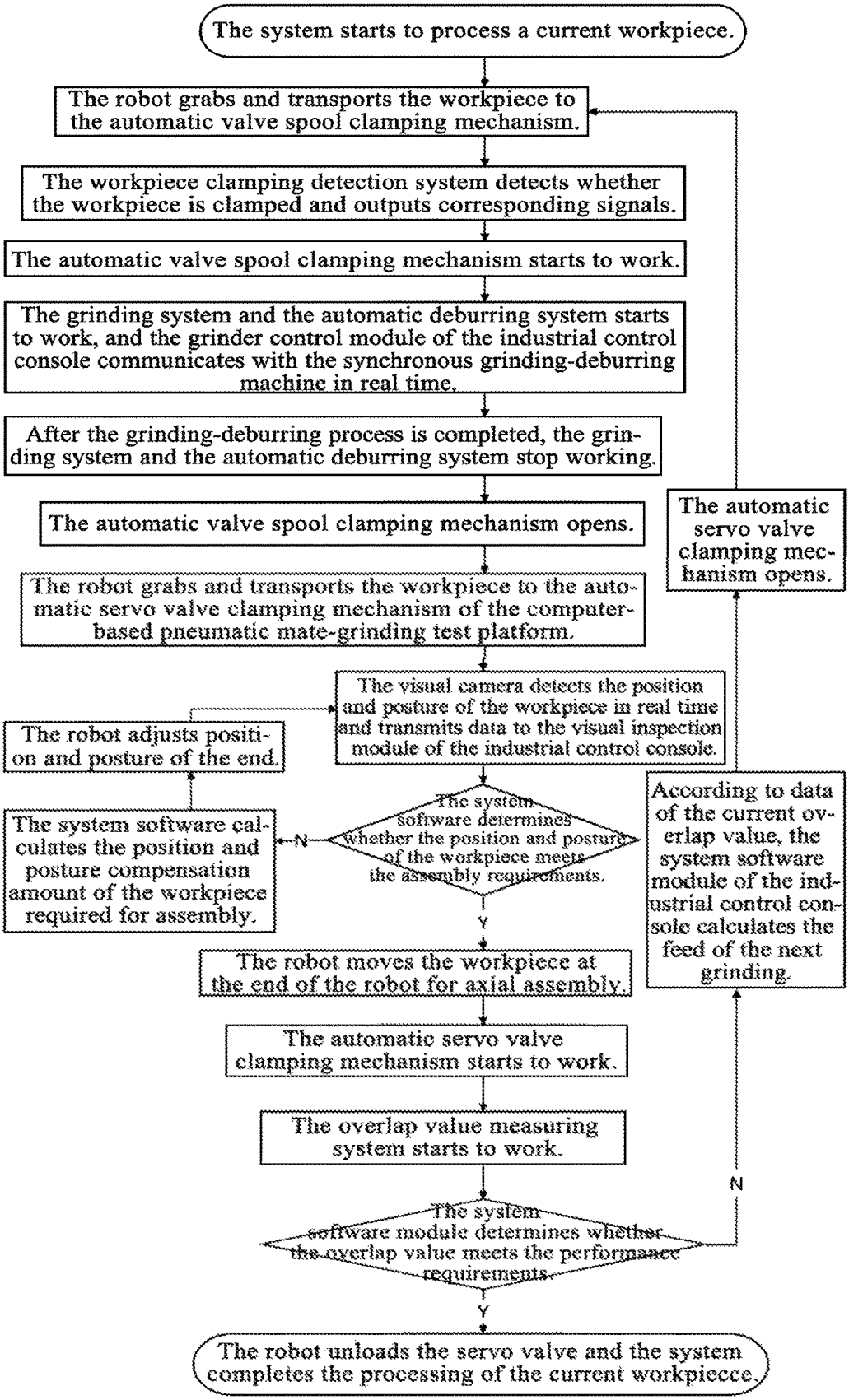
FIG. 2 is a flow chart of a synchronous grinding-deburring method for the valve spool workpiece according to an embodiment of the present disclosure.

Referring to an embodiment shown in FIG. 2, this application provides a synchronous grinding-deburring method for a valve spool based on measurement of an overlap value, including the following steps.

(1) Automatic Loading of Workpiece by Grinding-Deburring Machine

The robot control module of the industrial control console communicates with the loading-unloading robot in real time to control the robot to grab the valve spool workpiece to be processed and place it to the automatic valve spool clamping mechanism of the synchronous grinding-deburring machine. After the workpiece clamping detection system of the synchronous grinding-deburring machine detects that the workpiece has been well placed, the grinder control module of the industrial control console communicates with the synchronous grinding-deburring grinder in real time to allow the automatic valve spool clamping mechanism to perform its function to stably clamp the workpiece.

(2) Synchronous Grinding and Deburring

After the workpiece has been stably clamped, the grinding system and the automatic deburring system of the synchronous grinding-deburring machine start to operate. The grinding system automatically approaches an end surface of the workpiece to perform axial grinding, and the automatic deburring system simultaneously removes burrs from the working edge. At the same time, the grinder control module of the industrial control console communicates with the synchronous grinding-deburring machine in real time, such that when the processing is finished, the industrial control console controls the grinding system to stop running, the working part of the automatic deburring system to return to initial position and the automatic valve spool clamping mechanism to automatically open.

(3) Transfer of the Valve Spool Workpiece to the Computer-Based Pneumatic Mate-Grinding Test Platform The robot control module of the industrial control console communicates with the loading-unloading robot in real time to control the robot to grab the workpiece from the clamping mechanism of the synchronous grinding-deburring machine and transfer the workpiece to the automatic servo valve clamping mechanism of the computer-based pneumatic mate-grinding test platform for assembly of the slide valve pair.

(4) Automatic Assembly and Clamping of Slide Valve Pair

The CCD-based industrial visual camera automatically detects the position and posture data of the workpiece at the end of the robot in real time and transmits it to the visual monitor module. The visual monitor module exchanges data and information with a system software module, and the system software module obtains compensation amount of the position and posture of the workpiece according to pre-calibrated position and posture data required for assembly of the slide valve pair. At the same time, the robot control module communicates with the loading-unloading industrial robot in real time to control the industrial robot to adjust the position and posture at the end to meet the assembly requirements of the slide valve pair, such that the end of the robot controls the value spool to perform an axial movement to complete the assembly of the valve sleeve and the value spool. Then the automatic servo valve clamping mechanism clamps the servo valve for the measurement of the overlap value.

(5) Automatic Measurement of Overlap Value of Servo Valve, and Adaptive Control of Processing Flow and Parameters The computer-based pneumatic mate-grinding test platform detects the overlap value of the servo valve, and outputs test data to the test platform control module of the industrial control console. The test platform control module exchanges data and information with the system software module, and it is determined by the system software whether the overlap value of the servo valve meet preset requirements. If not, according to the measured overlap value of the workpiece, a feed amount required for the next grinding processing is determined, and the robot transports the valve spool workpiece to the synchronous grinding-deburring machine to undergo the grinding and deburring process. If yes, the automatic valve spool clamping mechanism is opened and the processed workpiece is unloaded with the cooperation of the robot to complete the whole manufacturing process. Then the next workpiece to be processed is subjected to grinding and deburring according to the above processing flow.

This application achieves the automation and integration of synchronous grinding-deburring processing of the servo valve spool and detection of the overlap value based on the combination of a synchronous grinding-deburring machine, a computer-based pneumatic mate-grinding test platform and a loading-unloading robot, facilitating the automated manufacturing of the servo valve. In addition, this application reduces the labor intensity and production cost, and effectively improves the processing efficiency and yield. At the same time, the individual working units are relatively independent and have a clear division of function and high flexibility and intelligence. As a consequence, the synchronous grinding-deburring method and system of the disclosure are suitable for the batch production of high-precision servo valves.

In this embodiment, the test workpiece is a 440 C stainless steel bar with a diameter of 10 mm and a radial runout of 0.18 μm. The synchronous grinding-deburring machine processes the workpiece at a feed speed of 8 μm/s and a rotation speed of 180 rpm. A total of 100 workpieces are processed and detected. The results show that the 100 samples all have a right-angled and sharp working edge free of burrs, and after the deburring treatment, a height of residual burrs on the working edge is about 0.5 The 100 samples all meet the process requirements, and the rejection rate is 0. Compared to the prior art, the synchronous grinding-deburring method provided herein increases the processing efficiency by 83% and the yield to more than 99%.

Described above are only preferred embodiments of the disclosure, which are not intended to limit the scope of the disclosure. It should be understood that any modifications, replacement and changes made by those skilled in the art without departing from the spirit of the disclosure should fall within the scope of the disclosure defined by the appended claims.

What is claimed is:

1. A synchronous grinding-deburring method for a valve spool workpiece based on measurement of an overlap value, comprising:

automatically loading, by a synchronous grinding-deburring machine, the valve spool workpiece;

synchronously grinding and deburring, by the synchronous grinding-deburring machine, a working edge of the valve spool workpiece;

grasping and transporting, by a loading-unloading robot, the valve spool workpiece;

performing automatic assembly of a slide valve pair with a charged-coupled device (CCD)-based visual camera;

automatically measuring, by a computer-based pneumatic mate-grinding test platform, the overlap value of a servo valve; and performing, by a control console, real-time control of a complete workflow and adaptive control of processing parameters;

wherein the synchronous grinding-deburring machine is provided with an automatic valve spool clamping mechanism, a workpiece clamping detection system, a grinding system and an automatic deburring system; and the synchronous grinding-deburring machine is configured to realize synchronous grinding and deburring of the valve spool workpiece, to cooperate with the loading-unloading robot to automatically clamp the valve spool workpiece, to check whether a clamping process is completed, and to output a clamping completion signal when the clamping process is detected to be completed;

the automatic loading of the valve spool workpiece is performed through steps of: grabbing and transporting, by the loading-unloading robot, the valve spool workpiece to a clamping jaw of the synchronous grinding-deburring machine; opening the clamping jaw to clamp the valve spool workpiece; automatically closing the clamping jaw by the automatic valve spool clamping mechanism to stably clamp the valve spool workpiece; and outputting the clamping completion signal to the control console after the workpiece clamping detection system detects that the valve spool workpiece is clamped;

the synchronous grinding and deburring of the working edge of the valve spool workpiece is performed through steps of: driving, by the synchronous grinding-deburring machine, the valve spool workpiece to rotate; axially grinding, by the grinding system, the valve spool workpiece; and at the same time, radially feeding and deburring, by the automatic deburring system, the valve spool workpiece;

the automatic assembly of the slide valve pair is performed through steps of: grasping and transporting, by the loading-unloading robot, the valve spool workpiece to be close to a valve sleeve clamped by an automatic servo valve clamping mechanism provided on the computer-based pneumatic mate-grinding test platform; at the same time, detecting, by the CCD-based visual camera above the automatic servo valve clamping mechanism, a position and posture of the valve spool workpiece at an end of the loading-unloading robot in real time; transmitting, by the CCD-based visual camera, position and posture data of the valve spool workpiece to the control console; and according to pre-calibrated position and posture data, controlling, by a system software, the loading-unloading robot to adjust an end position and posture; and controlling, by the end of the loading-unloading robot, the value spool workpiece to move axially to complete the assembly of the slide valve pair;

the computer-based pneumatic mate-grinding test platform is provided with an overlap value measuring system, the automatic servo valve clamping mechanism and an overlap data processing computer; and the computer-based pneumatic mate-grinding test platform is configured to cooperate with the loading-unloading robot to realize automatic assembly of the valve spool and the valve sleeve and automatic clamping of a servo valve, to measure and preliminarily process the overlap value of the servo valve, and to output the measured overlap value;

the automatic clamping of the slide valve pair is performed through steps of: when the CCD-based visual camera detects that the position and posture of the valve spool workpiece are matched with those of the valve sleeve, controlling, by the control console, the automatic servo valve clamping mechanism to clamp the servo valve;

the automatic measurement of the overlap value of the servo valve is performed through steps of: automatically measuring, by the overlap value measuring system, the overlap value of the slide valve pair; at the same time, processing, by the overlap data processing computer, the measured overlap value in real time, and outputting, by the overlap data processing computer, processed overlap value data to the control console;

the control console comprises a central control module, a first control module, a second control module, a third control module and a visual detection module; the first control module, the second control module, the third control module and the visual detection module are respectively connected to the central control module; the first control module is connected to the synchronous grinding-deburring machine and is configured to monitor a working status of the synchronous grinding-deburring machine and transmit a working control signal of the synchronous grinding-deburring machine; the second control module is connected to the loading-unloading robot and is configured to monitor a working status of the loading-unloading robot and transmit a movement control signal of the loading-unloading robot; the third control module is connected to the computer-based pneumatic mate-grinding test platform and is configured to monitor a working status of the computer-based pneumatic mate-grinding test platform and transmit a working control signal of the computer-based pneumatic mate-grinding test platform; the visual detection module is connected to the CCD-based visual camera and is configured to monitor a position and posture signal of the valve spool workpiece during the assembly of the slide valve pair; and the central control module is provided with a user-oriented workflow operation panel and a control interface to process status data from other modules to obtain real-time workflow control instruction data; and the real-time control of the complete workflow and the adaptive control of the processing parameters are performed through steps of: determining, by the system software, whether the overlap value of the servo valve composed of the valve spool workpiece and the valve sleeve meets preset requirements; if not, according to the measured overlap value, performing a calculation to determine a feed amount required for next grinding processing, and then transporting, by the loading-unloading robot, the valve spool workpiece to the synchronous grinding-deburring machine followed by synchronous grinding and deburring; and if yes, opening the automatic servo valve clamping mechanism and unloading the processed servo valve with the help of the loading-unloading robot to perform grinding and deburring on a next valve spool workpiece to be processed.

* * * * *